United States Patent [19]

Huang et al.

[11] Patent Number: 4,831,756

[45] Date of Patent: May 23, 1989

[54] ALBUM WITH REPLACEABLE FRONT COVER

[76] Inventors: Feng M. Huang; Tsann T. Lu, both of No. 49, Hsin Le Road, An Ping Industrial District, Tainan, Taiwan, China

[21] Appl. No.: 59,257

[22] Filed: Jun. 5, 1987

[51] Int. Cl.[4] ..... A47G 1/06; G09F 1/12

[52] U.S. Cl. ..... 40/158.1; 281/31

[58] Field of Search ..... 40/158 R, 159 R, 621; 281/31, 17, 19, 34

[56] References Cited

U.S. PATENT DOCUMENTS

| | | | |
|---|---|---|---|
| 1,998,640 | 4/1935 | Shaw | 40/158 R |
| 2,177,905 | 10/1939 | McKeehan | 40/621 |
| 2,477,470 | 7/1949 | Williams | 40/158 R |
| 2,677,910 | 5/1954 | Morgan | 40/158 R |
| 2,785,490 | 3/1957 | Fabry | 40/621 |
| 2,850,294 | 9/1958 | Ortis et al. | 281/31 |
| 3,025,623 | 3/1962 | Hunt | 40/158 R |
| 3,444,638 | 5/1969 | Jahn | 40/158 R |
| 3,751,839 | 8/1973 | Mitchell | 40/158 R |
| 3,786,584 | 1/1974 | Holson | 400/158 R |
| 4,001,960 | 1/1977 | Holson | 281/31 |
| 4,164,085 | 8/1979 | Steeb et al. | 281/31 |
| 4,172,332 | 10/1979 | Holes et al. | 281/31 |
| 4,393,612 | 7/1983 | Clark | 40/158 R |

*Primary Examiner*—Paul J. Hirsch

*Attorney, Agent, or Firm*—Lowe, Price, Leblanc, Becker & Shur

[57] ABSTRACT

This invention relates to an album with a replaceable front cover and in particular to one which mainly includes a thin iron sheeting placing at the each of the shallow edge of the front cover, a suitable number of raised projection and magnetic units as the back of a transparent cover in responding position to the edge of the shallow edge thereby urging the transparent cover firmly on to the shallow edge by means of the attraction between the magnetic unit and the thin iron sheet, and the fixing power of the raised projection and the magnetic units.

3 Claims, 2 Drawing Sheets

ALBUM WITH REPLACEABLE FRONT COVER

BACKGROUND OF THE INVENTION

This invention relates to an album with a replaceable front cover.

Heretofore, many replaceable front cover includes a suitable size of concave area made on the front cover for placing decorating sheet (photograph) which is cut in corresponding shape. When pressing and fixing the transparent cover, it gives a decoration and special visual feeling of a cover. In the above-mentioned method, the size of the decorating sheet is cut a bit larger than the shallow edge to make its margin fixed between the shallow edge and the board, and the size of the transparent cover is just the same or a bit larger than the diameter of the shallow edge, thus fixing a photograph in the shallow edge. But such method has the following drawbacks:

1. The size of the decorating sheet is bigger than the shallow edge; as a result, the decorating sheet may be damaged in the process if placed in.

2. The transparent cover, fixed with the shallow edge just by pressing in, may decrease the friction and loosen it.

The inventor, in order to improve the problems mentioned above has made another design by making an additional construction of two magnetic units and two raised projections at the bottom of the transparent cover. When composing, the decorating sheet is cut at the same size as the shallow edge and placed inside. The friction between the magnetic unit and the positioning channel of the shallow edge gives a first fixing power. The attraction between the magnetic units and the thin iron sheets gives the second fixing power and the friction between the raised projection and the shallow edge gives a third fixing power. Overall, the fixing result of the transparent cover is increased.

SUMMARY OF THE INVENTION

It is the primary object of the present invention to provide a better fixing structure between the transparent cover and the replaceable front cover of an album.

It is another object of the present invention to provide a better structure of positioning of the decorating sheet and prevent it from being damaged.

DETAILED DESCRIPTION OF THE PREFERRED EMBODIMENT

Figure 1:
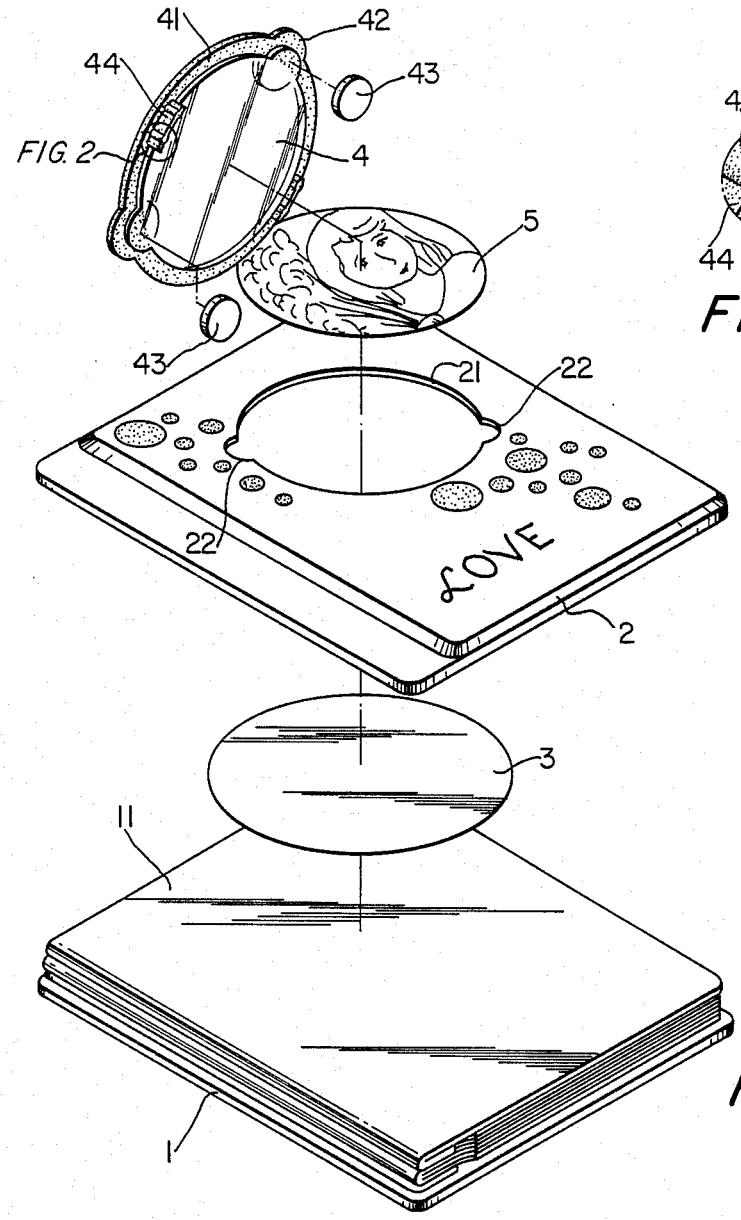
FIG. 1 is an exploded view of the present invention.

With reference FIG. 1, the present invention comprises an album 1, a front cover 2, a thin iron sheet 3 and a transparent cover 4 wherein the first and the last pages of the album 1 are made of board 11 with suitable thickness so that front cover 2 will be stuck thereon.

A shallow edge 21 is made on a suitable position of front cover 2 and two positioning channels are formed at the edge of the shallow edge 21.

The thin iron sheet 3, with its area just bigger than the shallow edge 21 of the front page 2, is stuck at the back of the shallow edge 21 (before board 11 is stuck on).

The transparent cover 4 is bigger than the shallow edge 21 with decorating edge 41 surrounding it. Two magnetic units can be fixed to the two positioning channels at the corresponding position of the shallow edge 21. At the lower edge of the transparent cover 4, there are two raised projections 44 each provided with a protuberance 45. The height of the raised projection 44 is the same as the magnetic units 43.

Figure 2:
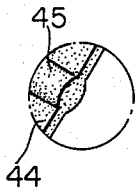
FIG. 2 is an enlarged fragmentary view of FIG. 1.

With reference to FIG. 2, when composing, the decorating sheet 5 (photograph) is cut at the same size as the shallow edge 21 and is placed inside the shallow edge 21 and covered by the transparent cover. When the transparent cover 4 covers on the shallow edge 21, decorating edge 41 covers the outer edge of the shallow edge 21 thus making it easier to pull. The friction between the two magnetic units 43 and the two positioning channels 22 of shallow edge 21 (the edge of the magnetic units 43 is fixed against the edge of the positioning channel 22 thus giving the first fixing power). The two magnetic units 43 when fixed in the positioning channel 22 also produces an attraction to the thin iron sheet 3 at the back of shallow edge 21 thus giving the second fixing power. The two protuberances 45 on the raised projections 44 of the transparent cover 4 is fixed tightly to the shallow edge 21 thus giving the third fixing power. The second fixing power mentioned above is given by permanent magnet power. The third fixing power is given by the elastic raised projection 44 and the protuberance 45 thus making it efficient. When the transparent cover 4 covered on the shallow edge 21, there is still a suitable distance between the transparent cover and the decorating sheet (equivalent to the thickness of the raised projection 44). Therefore, if the transparent cover 4 is a convex lens, there will be a good visual result in decorating sheet 5.

Figure 3:
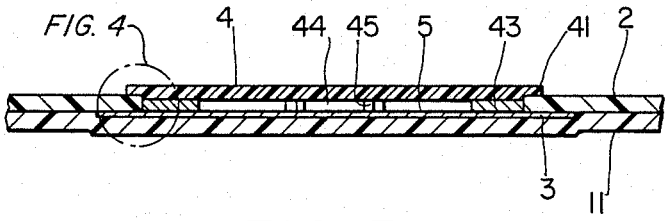
FIG. 3 is cross-sectional view of the present invention.
Figure 4:
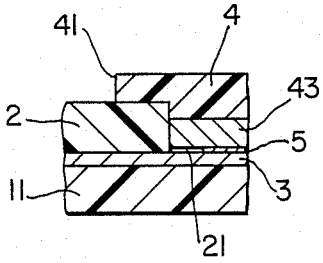
FIG. 4 is an enlarged fragmentary view of FIG. 3.
Figure 5:
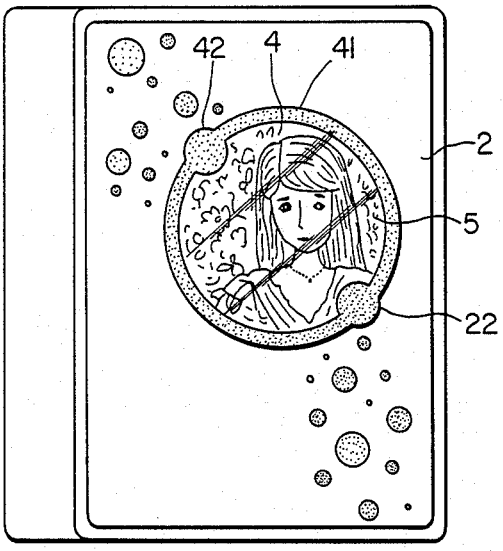
FIG. 5 is an exemplary embodiment of the present invention.
Figure 6:
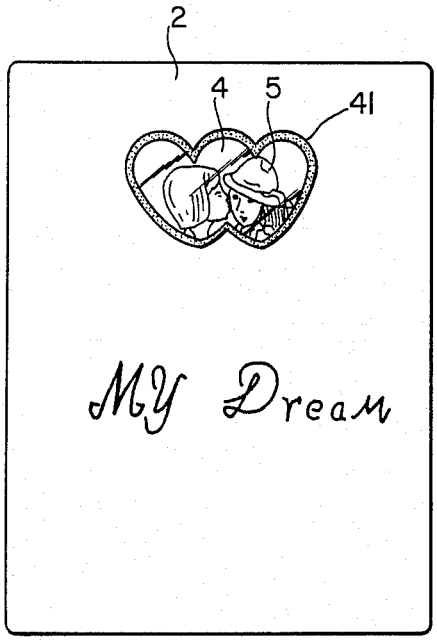
FIG. 6 is a second exemplary embodiment of the present invention.
Figure 7:
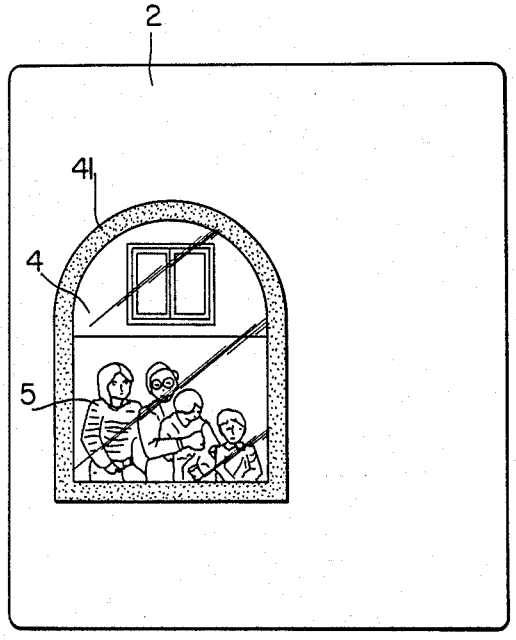
FIG. 7 is a third exemplary embodiment of the present invention.

Referring to FIG. 3, when the decorating sheet is covered by the decorating edge 41 of the transparent cover 4 and a suitable gap between the transparent cover 4 and the decorating sheet 5, it gives a special visual target and the character of the album is shown.

As the shallow edge 21 of the front cover 2 is not circular in shape, the positioning channel can be omitted, the magnetic units 43 give both an attraction to magnet and friction between the raised projection 44 and the shallow edge 21 still give three kinds of fixing power. In the two fixing methods above, the curvature of the raised projection 44 is corresponding to the curvature of the shallow edge, and the fixing edge of the magnetic unit 43 is made corresponding to the shallow edge.

In conclusion, the present invention has the following advantages.

1. It gives a firm and permanent fixing power between the transparent cover 4 and the shallow edge 21.

2. The decorating sheet 5 will not be damaged.

3. A special visual feeling is obtained by a suitable distance between the transparent cover 4 and the decorating sheet 5 when the transparent cover 4 is a convex lens.

I claim:

1. An album having an album body with a replaceable front cover provided with a decorating plate, comprising:

a front cover having an opening surrounded by an edge;

a transparent cover dimensioned to overlie said opening and said edge;

a magnetic sheet positionable between the album body and front cover to extend beneath the edge;

a plurality of raised projections extending downwardly from the transparent cover to engage the edge and magnetic units underlying the transparent cover about the edge to magnetically fix it to the magnetic sheet, said decorating plate thereby secured between the transparent cover and magnetic sheet.

2. An album with a replaceable front cover as claimed in claim 1, wherein the reaised projections of the said transparent cover are provided with protuberances engageable with said edge.

3. An album with a replaceable front cover as claimed in claim 1, wherein the raised projections of the said transparent cover each has substantially the same height as the magnetic unit to be spaced from the decorating plate when the transparent cover is covered thereon.

* * * * *